US005187325A

United States Patent [19]

Garvison

[11] Patent Number: 5,187,325

[45] Date of Patent: Feb. 16, 1993

[54] CYLINDRICAL BULLET

[76] Inventor: Geary L. Garvison, 13757 64th St., South Haven, Mich. 49090

[21] Appl. No.: 745,517

[22] Filed: Aug. 15, 1991

[51] Int. Cl.[5] ..... F42B 12/34

[52] U.S. Cl. ..... 102/509; 102/501; 102/503; 102/517

[58] Field of Search ..... 102/501, 503, 507-510, 102/514-519

[56] References Cited

U.S. PATENT DOCUMENTS

| | | | |
|---|---|---|---|
| 219,840 | 9/1879 | Winchester . | |
| 1,141,212 | 6/1915 | Ross . | |
| 1,292,388 | 1/1919 | Bowers . | |
| 2,661,694 | 12/1953 | Allen et al. . | |
| 3,138,102 | 6/1964 | Meyer et al. . | |
| 3,866,536 | 2/1975 | Greenberg . | |
| 4,044,685 | 8/1977 | Avcin | 102/510 |
| 4,048,922 | 9/1977 | Buljovcic | 102/509 |
| 4,193,348 | 3/1980 | Halverson | 102/509 |
| 4,245,557 | 1/1981 | Knappworst et al. | 102/510 |
| 4,495,869 | 1/1985 | Bisping | 102/503 |
| 4,777,883 | 10/1988 | Chevich | 102/503 |

FOREIGN PATENT DOCUMENTS

| | | | |
|---|---|---|---|
| 2028238 | 12/1971 | Fed. Rep. of Germany | 102/514 |
| 1850 | of 1897 | United Kingdom | 102/507 |
| 14717 | of 1900 | United Kingdom | 102/507 |

*Primary Examiner*—Harold J. Tudor

*Attorney, Agent, or Firm*—Gordon W. Hueschen

[57] ABSTRACT

There is described a cylindrical bullet or projectile having imbedded coaxially in lead or like bullet metal, a internal expansion control insert of copper or like bullet-jacketing metal. The insert has a cylindrical outer surface having a common cylindrical interface with the outer portion of the bullet. The inner surface of the insert has a star-shaped configuration constituted by lead-filled, axially-disposed, V-shaped channels the apices of which are adjacent the outer surface of the insert and the sides of which flare out symmetrically about radii to an intercept with the hollow core of the bullet which extends from a position at or near the base of the bullet as a cylindrical surface to a position at or near the nose of the bullet whereupon it extends on an inverted, frusto-conical surface to the nose-end of the bullet. The points of the stars are truncated on an arcuate surface and the base of the lead-filled channels have a complementary curvature so that the inner surface of bullet is formed of arcuate panels of lead alternating with arcuate panels of malleable bullet-sheathing copper. These panels are shaped by an axial core of the mold which has a top shaped as an inverted, frustrum of a cone and sides that first are parallel and then coverage to a point at the nose-end of the bullet. The bullet thus has a plurality of segments that are separated by portions of weakness and peel back on impact to effect mushrooming of the bullet.

17 Claims, 2 Drawing Sheets

CYLINDRICAL BULLET

FIELD OF THE INVENTION AND PRIOR ART

The invention relates to a cylindrical bullet or projectile of the kind that has a cylindrical body and a tapered nose. It is particularly directed to such a bullet that has internally-controlled expansion instead of those bullets that have external copper jacketing or other external means to control expansion on impact.

For some purposes it is desired that a bullet mushroom on impact as greater killing or knock-down power is thereby obtained. Various means are used to control this expansion and to prevent fragmentation of the bullet. Commercial bullets use specially designed copper jacketing for this purpose. One bullet manufacturer, for example, controls the expansion by means of copper jacketing which is thicker in the portions where otherwise excessive mushrooming and possible fragmentation is most likely to occur. Another provides a transverse partition so that the jacketing will not tear or banana-peel beyond the partition. Still another has an external jacket around a "star-shaped" lead bullet.

U.S. Pat. No. 4,777,883, issued 18 Oct. 1988 to M. Chevich, uses both an internal and an external jacket on a hollow lead bullet. The external jacket is made of plastic and has slits or notches in an empty nose-end which causes the jacket to collapse inwardly upon itself on impact. Expansion control is obtained by an annular notch in the exterior wall of the bullet plus the hardness of the metal used for the internal jacket as well as the thickness and taper of the internal jacket. The bullet lead is confined between these two jackets. It also has an asymmetrical gas seal which separates when the bullet leaves the muzzle of the gun.

U.S. Pat. No. 1,141,212, issued 1 Jun. 1915 to C. Ross, discloses an ordinary jacketed bullet with a closed-end tube axially disposed in the nose of the bullet.

U.S. Pat. No. 3,866,536, issued 18 Feb. 1975 to A. Greenberg, shows a bullet that mushrooms without peel-back which result is obtained by inserting a pellet in the hollow nose of the bullet.

U.S. Pat. No. 1,292,388, issued 21 Jun. 1919 to T. Bowers, shows a hollow bullet having an inner jacket of hardened steel.

U.S. Pat. No. 2,661,694, issued 8 Dec. 1953 to J. Allen et al., discloses a bullet having longitudinally-disposed steel splints in a bullet of lead and means in the nose of the bullet to cause the splints, on impact, to flare out as separate projectiles.

Other prior art, showing bullets which fragment or mushroom on impact, include U.S. Pat. Nos. 219,840; 3,138,102; and 4,048,922, but none of these show internally-controlled expansion.

SUMMARY OF THE INVENTION

The invention relates to a cylindrical, hollow-pointed bullet made chiefly of bullet metal, such as, bullet maker's lead, having internally-controlled expansion effected by incorporating, within the body of the bullet, an axially-disposed hollow, cylindrical insert of a malleable bullet-jacketing metal, such a bullet-jacketing copper, which, advantageously, has a cylindrical outer surface concentric with at least the upper portion of the bullet and an inner surface which is either circular or star-shaped in cross section and concentric with the axis of the bullet. The outer surface may have axially-disposed scoring (slots or slits) which form narrow, bullet-metal-filled channels which extend inward at least to adjacent the inner surface of the insert and constitute areas of weakness which divide the surface into segments which peel back on impact to cause mushrooming. Alternatively, the inner surface of the insert can have axially-disposed bullet-metal-filled V-shaped channels with the apices of the channels disposed adjacent the outer surface of the insert. These bullet-metal-filled channels are portions of weakness which allow the insert to peel back on impact. In both modifications, the insert is anchored in the base of the bullet and extends upwardly to, or adjacent to, the nose-end of the bullet. Advantageously, it has an upper end portion which has a shape conforming with the shape of the nose-end of the bullet, whereby the nose-end of the bullet is formed of malleable, bullet-jacketing metal.

The bullet of the invention has the advantage that it creates a deep permanent wound cavity as against the temporary wound cavity sought for and obtained by some bullet manufacturers.

The bullet of the invention can be cast in a two- or three-part mold in the usual manner. With the modification in which the insert has a star-shaped inner surface, advantage thereof can be taken to center the insert in the mold by having the star-shaped portions fit snugly on an axially-disposed cylindrical portion of the mold which forms the hollow portion of the bullet.

BRIEF DESCRIPTION OF THE INVENTION

The invention relates to a hollow, cylindrical bullet comprising:

an outer portion and a base portion comprised essentially of bullet metal, and an inner portion comprised essentially of a composite of malleable bullet-jacketing metal and bullet metal in which the jacketing metal has a common cylindrical interface with the outer portion;

the jacketing metal having axially-disposed portions of weakness separating the bullet into peel-back segments which peel back on impact to cause the bullet to mushroom;

in which the hollow extends axially down into the body of the bullet to the base of the bullet on the surface of an inverted truncated cone and thereafter axially down to the base of the bullet; and in which the jacketing metal is anchored in the base portion but terminates short of the bottom of the bullet.

The invention also includes one or more further features in which the portions of weakness are delineated by axially-disposed, bullet-metal-filled channels in which the channels open outwardly and are filled with bullet metal of the outer portion;

in which the channels open inwardly and are filled with bullet metal of the inner portion;

in which the interface adjacent the nose of the bullet flares out to the outer surface of the bullet, whereby the outer portion terminates short of the nose-end of the bullet and at least the upper part of the nose is comprised of bullet-jacketing metal; and in which the channels are V-shaped channels and in which the sides of the V's flare out symmetrically to intercept the surface of the hollow and demark, delineate, or topographically depict the surface of the intercepted hollow surface into arcuate panels of bullet metal alternating with arcuate panels of bullet-jacketing metal.

The invention also relates to a bullet of the class described which has a tapered nose portion and a cylindrical body portion comprising:

an outer portion comprised of bullet lead which portion has a cross section taken in any radial plane which is bounded by two concentric circles;

an inner portion comprised of a composite of bullet lead and malleable bullet-jacketing metal the outer face of which inner portion comprises the last named metal and is in juxtaposition to the inner face of the outer portion and has a common interface therewith;

the inner portion having longitudinally disposed portions of weakness dividing the bullet into a plurality of peel-back segments which peel back on impact, and the inner composite portion having a inner surface extending down from the nose portion on the surface of an inverted truncated cone and then on down through the body portion of the bullet to the base portion; and the bullet-jacketing metal portion of the composite being anchored in the base portion.

The invention also relates, as a subcombination, to an expansion-control insert for a hollow, cylindrical bullet comprising a hollow tubular member of malleable, bullet-jacketing metal having a cylindrical outer surface concentric with a star-shaped inner surface which forms a plurality of axially-disposed, V-shaped channels separating said insert into peel-back segments, the apices of said V-shaped channels being adjacent said outer surface; and to one or more features in which the points of said star-shaped surface are truncated on arcuate surfaces having a common center and the same radii;

in which the insert has a nose portion and a body portion and in which the sides of said V-shaped channels flare out toward the axis and terminate on the surface of an axially-disposed, cylindrical surface in substantially equally-spaced relation in the body portion of said insert and taper in the nose portion of said insert to a point at the nose-end thereof; and in which the outer surface of said insert, adjacent the nose thereof, flares out and then curves back to the nose-end of the insert.

The invention also pertains to a hollow, cylindrical bullet comprised essentially of bullet metal having axially disposed therein, between the outer surface of said bullet and a surface demarking the hollow of the bullet, an expansion control insert comprising a hollow cylinder of malleable, bullet-jacketing metal having a cylindrical outer surface spaced inwardly from and concentric with the outer surface of the bullet, said insert having axially-disposed, bullet-metal-filled, channels which separate said insert into peel-back segments and said bullet having an inner cylindrical surface composed at least partially of bullet metal; and one or more further features;

in which the inner surface of said insert comprises a plurality of segments separated by bullet-metal-filled, V-shaped said channels, the apices of which are adjacent to the outer surface of said insert there forming lines of weakness that permit said segments to peel back on impact;

in which said insert is completely surrounded by bullet lead and in which the outer surface of said insert is separated into a plurality of segments by said channels, the bottoms of which channels are adjacent to the inner surface of said insert and there form lines of weakness that permit said segments to peel back on impact; and in which said insert has a star-shaped inner surface with a plurality of points which are truncated on arcuate surfaces having a common center and the same radii.

The invention also relates to a bullet of the class described in which said portions of weakness comprise spaced, outwardly-opening, longitudinal channels in the malleable bullet-jacketing metal, which channels are filled with bullet lead of said outer portion and in which the inner surface of said inner portion is comprised of bullet lead and is cylindrical up to adjacent the nose of the bullet;

in which said portions of weakness comprise inwardly opening, longitudinal channels in the malleable, bullet-jacketing metal, which channels are filled with bullet metal of said inner portion and in which the inner surface of the inner portion is a cylindrical surface up to adjacent the nose of the bullet and there flares out as a right, frusto-conical surface, and comprises panels of bullet metal alternating with panels of bullet-jacketing metal; and in which said interface is cylindrical up to adjacent the nose of said bullet and there flares out to the surface of the bullet and then curves back to the nose-end of the bullet, whereby the surface of the bullet above said flare is made of said bullet-jacketing metal.

DESCRIPTION OF PREFERRED EMBODIMENTS OF THE INVENTION

FIGS. 1–4 show a modification in which the bullet 10, which is basically comprised of bullet metal, advantageously, bullet maker's lead. By bullet maker's lead is to be understood those forms of lead or lead alloys commonly used in making bullets because of the density and malleability. Plain ordinary lead, which can be purchased from any plumber's supply, is suitable. In short, any lead that is commonly used in making bullets that are designed to mushroom on impact can be used.

Figure 4:
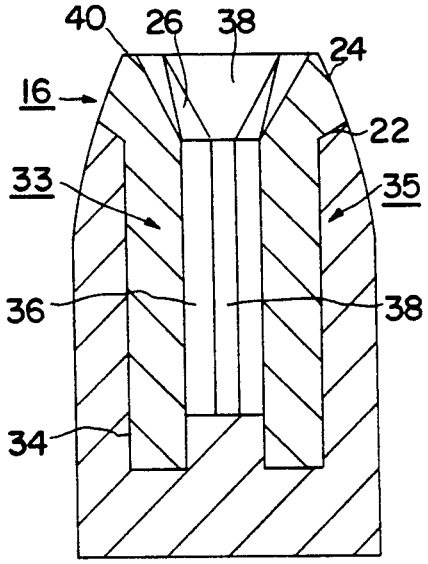
FIG. 4 is a cross section taken on line 4—4 of FIG. 2
Figure 5:
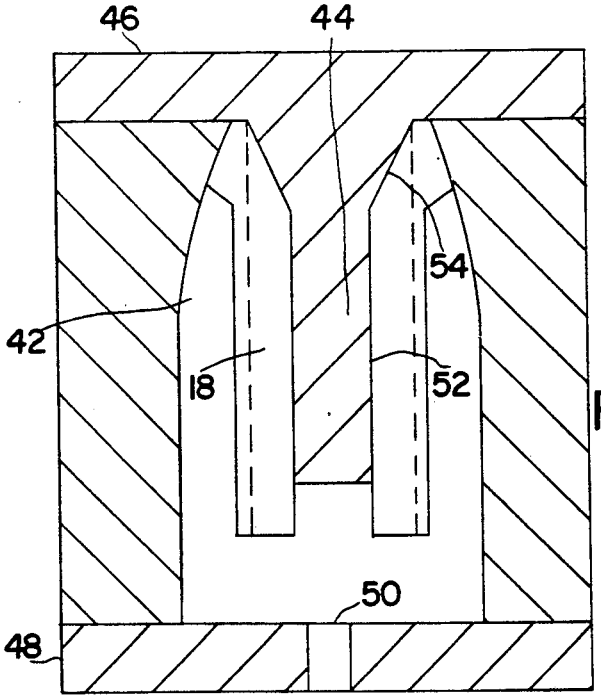
FIG. 5 is a cross section of a mold.
Figure 6:
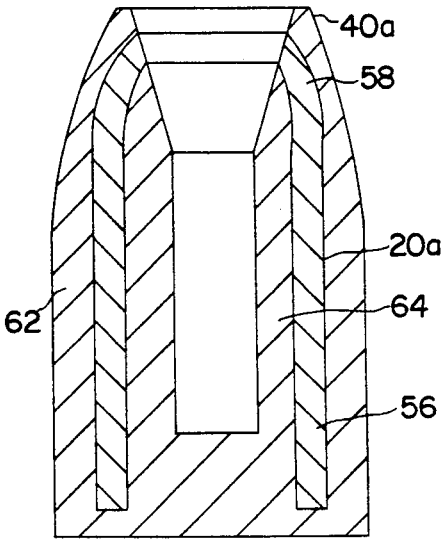
FIG. 6 is a cross section of another modification of the invention.

The bullet 10 has a cylindrical base and body portions 12 and 14 and a tapered nose portion 16, (see FIG. 4). Extending axially into the bullet 10 is a tubular expansion control insert 18 composed essentially of malleable bullet-jacketing metal. The insert 18 and the bullet 10 have a common, right-cylindrical interface as shown at 20. This interface flares out to the outer surface of the nose portion 16 as shown at 22 and thereafter continues as the outer surface 24 of the nose portion 16. The insert extends down through the body portion 14 to or into the base portion 12.

Unless otherwise specified the term cylinder is to be understood as a right cylinder, i.e., a cylinder any normal section of which is a circle. Similarly, malleable bullet-jacketing metal is to be understood the kind of copper or copper alloy, for example brass or like malleable metal, which is used, or can be used, in jacketing bullets for the purpose of preventing fragmentation and for controlling the extent of mushrooming on impact. Also, it is to be understood that terms of orientation refer only to the drawings and not to the bullet. Also, the term as "axially-disposed" is intended to include any disposition parallel to the axis. For example, the elements of a cylindrical surface are "axially-disposed" in that they extend in the same direction as the axis although parallel thereto.

In the modification of FIGS. 1–4, the inner surface is a star-shaped cylindrical surface, or right polygonal surface, generated by a line moving on the circumference of a star-shaped figure parallel to a line normal to the star-shaped figure. The star-shaped figure is a right polygon meaning that it has equal sides symmetrically oriented about the center. This is accomplished by forming the inner portion of the insert 18 with a plurality of axially-disposed (longitudinally-disposed) V-shaped channels 26. The apices 28 of these V-shaped channels extend to adjacent the outer wall of the insert 18 as can be readily seen in FIGS. 1, 2, and 3. Each of these channels is filled with bullet metal. The side of the V-shaped channels flare out from the apex symmetrically with respect to the radial plane defined by the apex and the axis. The result is a plurality of peel-back segments 30 which peel back on impact and cause the bullet to mushroom. The segments, before peel-back, constitute the inner composite portion 33 of the bullet (see FIG. 4). This portion is surrounded by the outer portion 35 consisting essentially of bullet metal. Both portions 33 and 35 have juxtaposed annular cross sections with a common circle which constitutes the interface 20.

Figure 1:
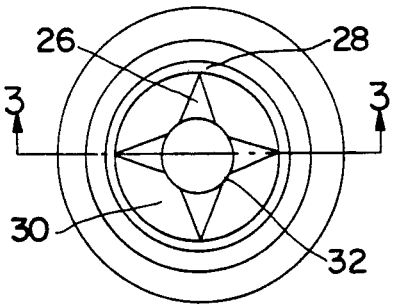
FIG. 1 is a top plan view of a bullet of the invention.
Figure 2:
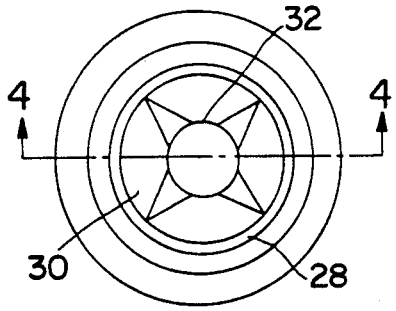
FIG. 2 is a top plan view rotated 90° with respect to FIG. 1.
Figure 3:
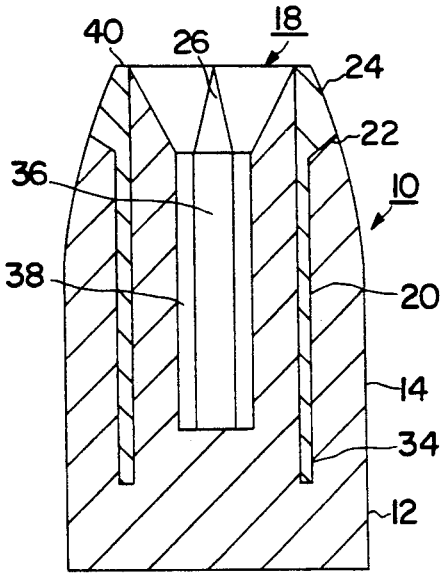
FIG. 3 is a cross section taken on line 3—3 of FIG. 1.

In the center of the bullet is an empty space forming the hollow of the bullet. It is delineated by the circle 32 in FIGS. 1 and 2 and the frusto-conical sections see in FIGS. 3 and 4. This empty space extends down to the base as seen in FIGS. 3 and 4 leaving a massive amount of bullet metal forming the base 12 with the ends 34 of the insert being anchored therein. The inner wall of the bullet thus is composed of arcuate panels 36 of bullet metal alternating with arcuate panels 38 of malleable, bullet-jacketing metal. This inner wall coincides with a right cylindrical surface up to the nose portion 16 of the bullet about to the same level as the flare 22 and then flares out on an inverted frusto-conical surface to the nose-end 40 of the bullet. Beginning at the top of the cylindrical portion, the alternating panels 36 and 38 taper to a point at the nose-end 40 as best seen in FIGS. 3 and 4.

The bullet is made by placing the insert 18 in a hollow mold having a cavity 42 shaped like the bullet. The cavity has an axially-disposed portion 44 which extends axially into the mold and forms the hollow of the bullet. The insert fits snugly on the axially-disposed portion and no other means for positioning the insert in the mold is required. The mold can be made in as many parts as wanted or needed. However, it is of advantage to have the axially disposed portion 44 formed integral with the cap 46 and to have a separable base 48 with an axially-disposed pour-hole 50 therein. The axially-disposed portion 44 has a bottom cylindrical portion 52 and a upper inverted frusto-conical portion 54 conforming to the desired shape of the hollow of the hollow bullet as already described.

Figure 7:
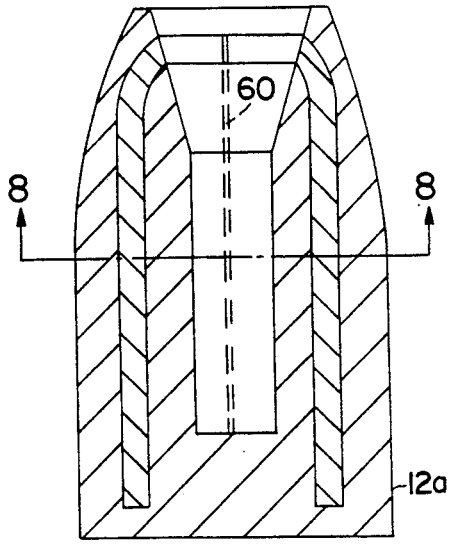
FIG. 7 is a cross section having a different orientation which show the V-shaped channels in phantom lines.
Figure 8:
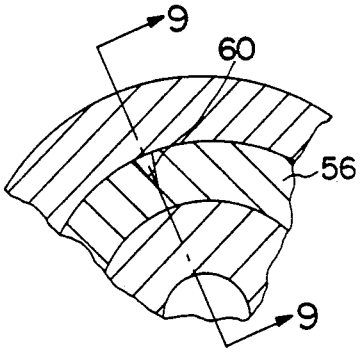
FIG. 8 is a partial view taken in section on line 8—8 of FIG. 7.

In the modification shown in FIGS. 6–9, the insert is made of a tube 56 of bullet-jacketing metal which has its nose-end 58 swaged in as shown and is encased in bullet metal providing an outer portion 62, an inner portion 64, and a base portion **12*a* in which it is firmly anchored. As best seen in FIGS. 7 and 8, the outer surface of the tube 56 is deeply scored axially to provide bullet-metal-filled, channels 60. These channels are much narrower than those in FIGS. 1–4 and can, if desired, be intermittent cuts (not shown) through the wall of the tube 56. In any event they separate the interface between the insert and the outer portion 62** into narrow panels of bullet-metal alternating with broad panels of bullet-jacketing metal which peel back on impact to cause mushrooming.

Figure 10:
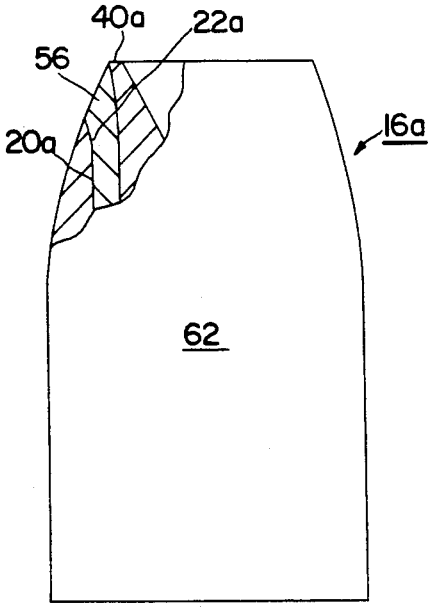
FIG. 10 is a plan view of another modification with parts broken away and in section to show details which differ from the modification shown in FIGS. 6–9.
Figure 9:
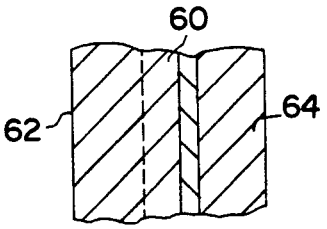
FIG. 9 is a partial view in section taken on line 9—9 of FIG. 8.

In the modification shown in FIG. 10, the tube **56*a* is swaged out at the end as shown to provide that the nose 16*a* will have at least the upper part made of bullet-jacketing metal. Thus, the interface 20*a* flares outwardly at 22*a* to the surface of the bullet thereby terminating the outer bullet-metal portion short of the nose-end 40*a* just as in FIGS. 1–4. Of course the modification of FIG. 10 has narrow channels just as in FIGS. 8 and 9** and would show like cross sections.

It is to be understood that the bullet can be coated with graphite, Teflon, nylon, or the like, as this is common in the art for the purpose of altering the ballistics or to prevent fouling. Thus, the term "outer portion" is not to be construed as excluding such exterior coating or sheathing.

While the invention has been described with reference to particular embodiments thereof, it is to be understood that it is not to be limited to the details of these embodiments, as variations will readily become apparent to those skilled in the art once they have been apprised of the invention, and that the invention, accordingly, is not to be limited except by the scope of the appended claims.

I claim:

1. A hollow, pointed, cylindrical bullet comprising:

an outer portion and a base portion comprised essentially of bullet metal, and an inner portion comprised essentially of a malleable bullet-jacketing metal portion and a bullet metal portion;

said inner and outer portions having a common cylindrical interface, an outer face of which is comprised essentially of bullet metal and an inner face of which is comprised essentially of said bullet-jacketing metal;

said jacketing metal portion having adjacent said interface axially-disposed portions of weakness separating said bullet into peel-back segments at least an upper part of which portions of weakness is composed of intact bullet-jacketing metal which tears apart on impact thereby allowing said segments to peel back to cause the bullet to mushroom;

in which an inner surface of said hollow bullet extends axially down into the body of said bullet toward said base portion on a surface of an inverted truncated cone and thereafter axially down to said base portion; and in which said jacketing metal portion is anchored in said base portion but terminates short of the bottom of said bullet.

2. A bullet of claim 1 in which said portions of weakness are delineated by axially-disposed, bullet-metal-filled channels.

3. A bullet of claim 2 in which said channels open outwardly and are filled with bullet metal of said outer portion.

4. A bullet of claim 2 in which said channels open inwardly and are filled with bullet metal of said inner portion.

5. A bullet of claim 1 in which said interface adjacent the nose of said bullet flares out to the outer surface of the bullet, whereby said outer portion terminates short of the nose-end of the bullet and at least the upper part of said nose is comprised of bullet-jacketing metal.

6. A bullet of claim 4 in which said channels are V-shaped channels and in which the sides of the V's flare out symmetrically to demark arcuate panels of bullet metal alternating with arcuate panels of bullet-jacketing metal of substantially equal width.

7. A hollow bullet of claim 1 in which:

said bullet metal is comprised essentially of bullet lead and said malleable bullet-jacketing metal is comprised essentially of bullet-jacketing copper or bullet-jacketing copper alloy.

8. A bullet of claim 1 in which said portions of weakness comprise spaced, outwardly-opening, longitudinal channels in said malleable bullet-jacketing metal, which channels are filled with bullet lead of said outer portion and in which the innermost portion of said inner portion is comprised essentially of bullet lead and is annulo-cylindrical up to adjacent the nose of the bullet.

9. A bullet of claim 1 in which said potions of weakness comprise inwardly opening, longitudinal channels in said malleable, bullet-jacketing metal, which channels are filled with bullet lead of said inner portion and in which the inner surface of said inner portion is a cylindrical surface up to adjacent the nose of the bullet and there flares out as a right, frusto-conical surface, and comprises panels of said bullet lead alternating with panels of said bullet-jacketing metal of substantially equal width.

10. An expansion-control insert for a hollow, cylindrical bullet comprising a hollow tubular member open at both ends of malleable, bullet-jacketing metal selected from bullet-jacketing copper or bullet-jacketing copper alloy having an imperforate cylindrical outer surface and a star-shaped inner portion formed by a plurality of axially-disposed, V-shaped channels which extend the entire length of the insert, the apices of which channels are adjacent said outer cylindrical surface, thereby forming adjacent thereto axially-disposed, parallel, imperforate tear-lines separating said insert into peel-back segments, and the sides of which channels flare out to essentially equally disposed sites on the surface of an axially-disposed, cylinder which is concentric with said cylindrical outer surface, the points of said star-shaped portion being thus truncated on arcuate surfaces having a common axial center and the same radii, whereby said arcuate surfaces constitute axially-disposed, spaced-apart panels which are essentially equally spaced one from another.

11. An expansion-control insert of claim 10 which has a nose portion and a body portion and in which, in said nose portion, the sides of said V-shaped channels flare out and terminate on the surface of an inverted frustom of a cone which flares out from the top of said cylinder to the nose end of said insert, thereby forming substantially equally-spaced, outwardly flaring extensions of said axially-disposed panels which taper to a point at the nose-end of said insert.

12. An expansion control insert for a hollow, cylindrical bullet comprising a hollow tubular member of malleable, bullet-jacketing metal having a cylindrical outer surface concentric with a star-shaped inner surface which forms a plurality of axially-disposed, V-shaped channels separating said insert into peel-back segments, the apices of said V-shaped channels being adjacent said outer surface;

which has a nose portion and a body portion and in which the sides of said V-shaped channels flare out toward the axis and terminate on the surface of an axially-disposed, cylindrical surface in substantially equally-spaced relation in the body portion of said insert and taper in the nose portion of said insert to a point at the nose-end thereof; and in which the outer surface of said insert, adjacent the nose thereof, flares out and then curves back to the nose-end of the insert.

13. A hollow, cylindrical bullet comprised essentially of bullet lead having axially disposed therein, between the outer surface of said bullet and an inner surface demarking the hollow of the bullet as an axial-disposed void, an expansion control insert comprising a body of malleable, bullet-jacketing metal selected from bullet-jacketing copper and bullet-jacketing copper alloy having a cylindrical outer surface spaced inwardly from and concentric with the outer surface of said bullet, said insert having axially-disposed, bullet-lead-filled, channels which separate said insert into segments which tear apart from each other and peel back on impact and an inner surface of said bullet being composed at least partially of bullet lead.

14. A bullet of claim 13 in which the outer surface of said insert is imperforate and the inner portion of said insert comprises a plurality of segments separated by bullet-metal-filled, V-shaped said channels, the apices of which are adjacent to the outer surface of said insert there forming intact lines of weakness that permit said segments to tear away and peel back on impact.

15. A bullet of claim 14 in which said insert is completely surrounded by bullet lead and in which the inner surface of said insert is separated into a plurality of segments by said channels which demark the surface of said axially-disposed void and divide it into arcuate panels of said bullet lead alternating with arcuate panels of said bullet-jacketing metal of substantially equal width.

16. A bullet of claim 14, in which the bullet-jacketing metal portion of said insert has a star-shaped inner portion with a plurality of points which are truncated on arcuate surfaces having an axially-disposed common center and the same radii.

17. A hollow, pointed, cylindrical bullet comprising:

an outer portion and a base portion comprised essentially of bullet metal, and an inner portion comprised essentially of a composite of a malleable bullet-jacketing metal portion and a bullet metal portion;

said inner and outer portions having a common cylindrical interface, an outer face of which is comprised essentially of said bullet metal and an inner face of which is comprised essentially of said bullet-jacketing metal;

said jacketing metal portion having axially-disposed portions of weakness adjacent said interface separating said bullet into peel-back segments which peel back on impact to cause the bullet to mushroom;

in which an inner surface of said hollow bullet extends axially down into the body of said bullet toward said base portion on a surface of an inverted truncated cone and thereafter axially down to said base portion; and in which said jacketing metal portion is anchored in said base portion but terminates short of the bottom of said bullet;

in which said portions of weakness comprise inwardly opening, longitudinal channels in said malleable, bullet-jacketing metal portion, which channels are filled with bullet metal of said inner portion and in which an inner surface of said inner portion is a cylindrical surface up to adjacent the nose of the bullet and there flares out as a right frusto-conical surface, and comprises panels of bullet metal alternating with panels of the bullet-jacketing metal; and in which said interface is cylindrical up to adjacent the nose of said bullet and there flares out to the surface of the bullet and then curves back to the nose-end of the bullet, whereby the surface of the bullet above said flare is made of said bullet-jacketing metal.

* * * * *